United States Patent [19]

Chong

[11] Patent Number: 4,497,409

[45] Date of Patent: Feb. 5, 1985

[54] SEAM INSPECTION APPARATUS

[76] Inventor: Wun C. Chong, 69 Wallace Place, Delta, British Columbia, Canada

[21] Appl. No.: 453,203

[22] Filed: Dec. 27, 1982

[51] Int. Cl.[3] ..... B07C 5/02

[52] U.S. Cl. ..... 209/538; 209/587; 198/394; 356/428

[58] Field of Search ..... 209/538, 576, 577, 524, 209/528, 587, 903, 919; 198/378, 394, 377, 343, 344; 356/426, 428, 237; 250/223 B

[56] References Cited

U.S. PATENT DOCUMENTS

| | | | |
|---|---|---|---|
| 3,356,212 | 12/1967 | Landin | 209/538 X |
| 3,577,919 | 5/1971 | Usko | 198/344 X |
| 3,601,616 | 8/1971 | Katsumata | 209/524 X |
| 4,075,086 | 2/1978 | Marsh et al. | 209/538 X |
| 4,158,625 | 6/1979 | Takahashi et al. | 209/538 X |

*Primary Examiner*—Robert B. Reeves
*Assistant Examiner*—Glenn B. Foster
*Attorney, Agent, or Firm*—Fetherstonhaugh & Co.

[57] ABSTRACT

An apparatus to permit inspection of an object. The apparatus has a track with which the object can move. There is a carriage to carry the object along with the track. A clamp holds the object as it moves. An inspection zone is positioned on the track. There is a brake to stop the object moving along with the track at the inspection zone and the object is rapidly rotated in the inspection zone so it may be inspected, for example, by camera.

20 Claims, 7 Drawing Figures

112
142
130
140
96
108
80
85
84
100
113
114
104
110
102
106
50
56
58
60
64
54
89
84
66
51
34
46
44
40
42
118
126
70
72
74
77
32
45
36
39
41
43
47
38
35
26
24
28
30
31
18
20
22
10
16
2
6
12
14
8
4
148
142
112
113
130
140
80
108
174
85
78
75
48
118

SEAM INSPECTION APPARATUS

FIELD OF THE INVENTION

This invention relates to a machine to assist in the inspection of objects.

DESCRIPTION OF THE PRIOR ART

In mass production techniques it is desirable that the object produced be inspected as a last step in its production to determine that all the necessary steps have been carried out and carried out properly. This is particularly true in canning where the seams of the finished cans must be inspected to see that they are of the appropriate quality to ensure that the goods do not deteriorate in the can and remain free of bacteria.

The earliest and most obvious method of inspecting cans is by simple visual inspection. However simple visual inspection represents a considerable slowdown in a modern production line, with consequent increase in cost of production, and such techniques have long been seen as a point where improvement is required. Equipment has been used that automatically inspects the can using scanning equipment. However the problem with the prior art equipment is that it is laborious in that it normally involves the complete rotation of the inspecting equipment to go round the seams at the top and bottom of the can to determine that they are complete.

SUMMARY OF THE INVENTION

The invention therefore seeks to make substantial improvements in the inspection of objects and finds particular application in the inspection of the seams in a canning line. The present equipment provides substantial improvements in speed over the prior art equipment.

Accordingly, the present invention provides an apparatus to permit inspection of an object, the apparatus comprising:

- a movable track with which the object can move;
- means to carry the object along with the track;
- clamping means to hold the object as it moves;
- means defining an inspection zone on the track;
- means to stop the object moving with the track at the inspection zone; and
- means to rotate the object in the inspection zone so it may be inspected.

BRIEF DESCRIPTION OF THE DRAWINGS

Aspects of the invention are illustrated, merely by way of example, in the accompanying drawings in which.

DESCRIPTION OF THE PREFERRED EMBODIMENT

Figure 4:
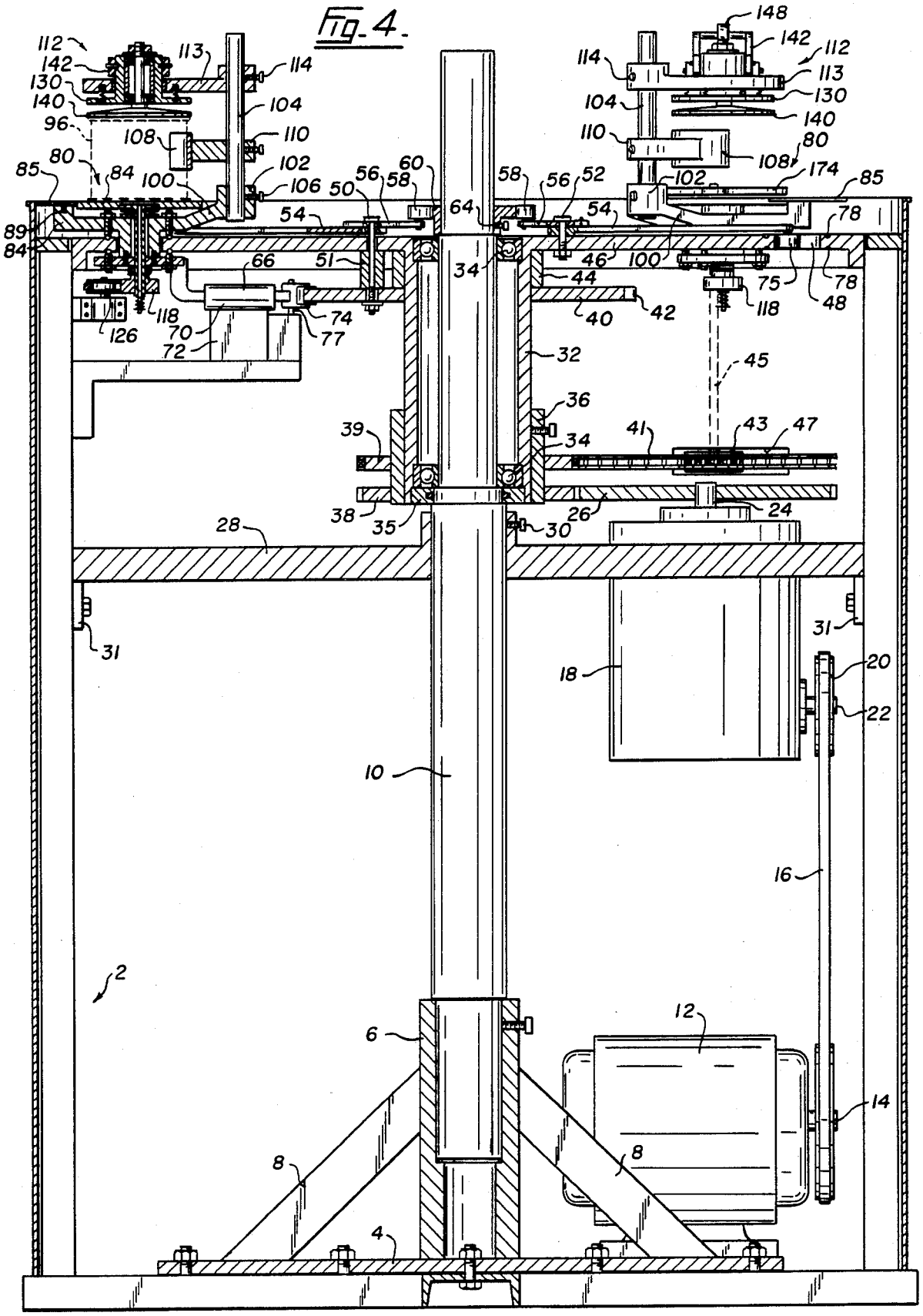
FIG. 4 is a section on the line 4—4 in FIG. 3.

The drawings show a machine useful in the inspection of cans and comprising a frame generally indicated 2 in FIG. 4 and with plate 4 bolted to it. The plate 4 has a housing 6 extending upwardly and braced by members 8 and a shaft 10 extends from the housing 6 to the top of the machine. The plate 4 carries an electric motor 12 used to drive the machine. An output shaft 14 of the electric motor 12 has a belt 16 driving a gearbox 18 through a pulley 20 on the input shaft 22 of the gearbox 18. The output shaft 24 gearbox has a sprocket 26 mounted on it. The gearbox 18 is mounted on a plate 28 engaged on the shaft 10 by a bolt 30 and located in the frame 2 at 31.

The sprocket 26 drives a tubular member 32 mounted on the shaft 10 on bearings 34, the lower of which is protected by oil seal 35. The tubular member 32 is located in an outer sleeve 36 to which is attached a sprocket 38. A cam plate 40 with cams 42 is located on flanges 44 on the member 32. A sprocket 39 is also attached to sleeve 36. Sprocket 39 drives chain 41 to turn sprockets 43 (see FIGS. 1 and 4) and thus a shaft 45 outside frame 2. Chain 41 passes through opening 47.

Figure 3:
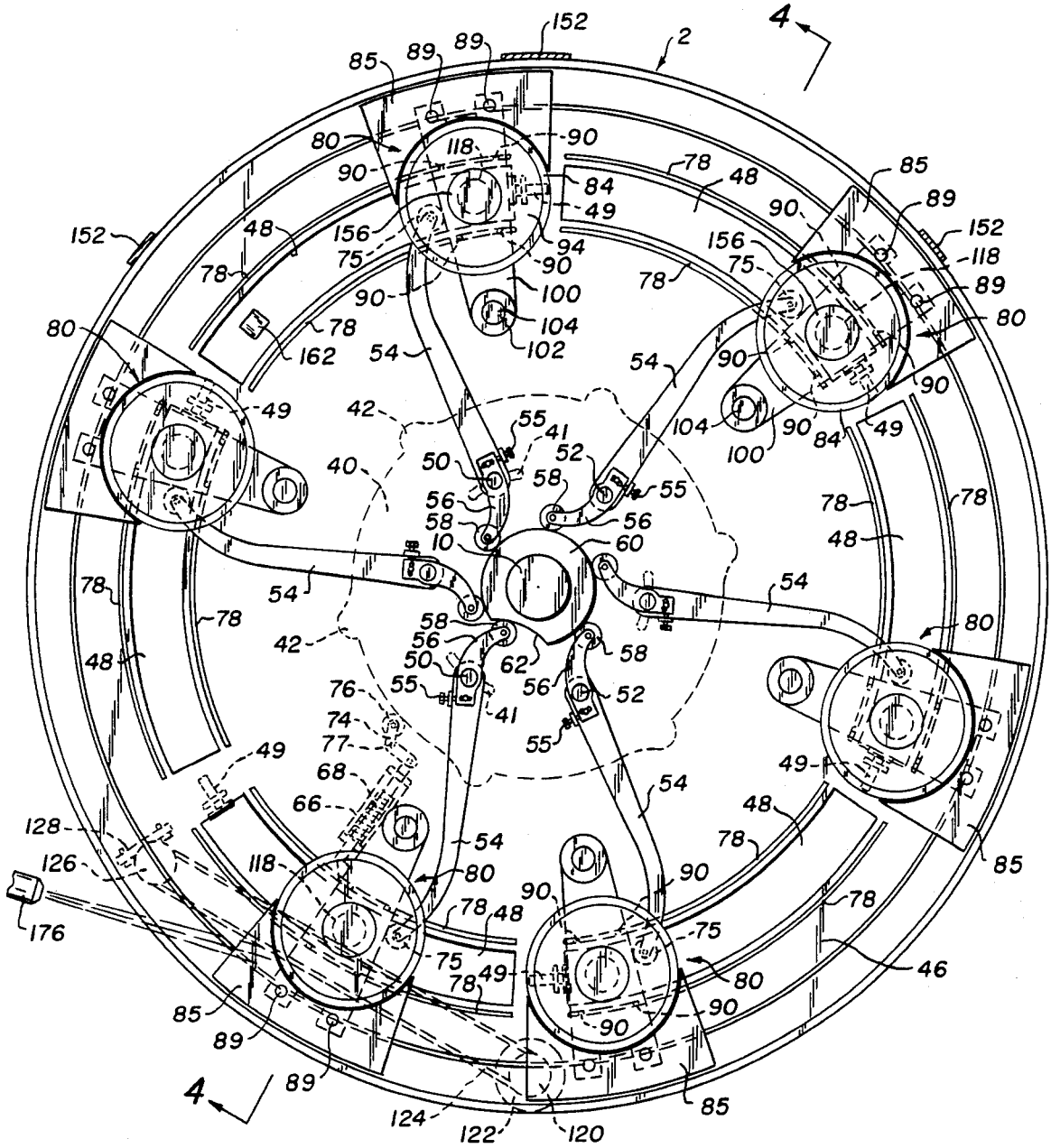
FIG. 3 is a plan view, also partial, showing a detail of the equipment according to the invention.

A table 46 formed with openings 48 that define a track is formed at the top of the member 32. Bolts 50, such as shown in FIG. 4, ensure that the cam plate 40 rotates with the table 46. Slots 41' (FIG. 3) permit variation in the relative positions for plate 40 and table 46 for adjusting the timing between plate 40 and table 46. Spacers 51 are positioned around bolts 50 to assist in locating table 46. Bolts 52 in the table 46 pivotally attach arms 54, as shown best in FIGS. 1 and 3. These arms 54 extend to a dog-leg 56 attached to a roller 58 contacting a flange 60 on the shaft 10. As particularly shown in FIGS. 1 and 3 the flange 60 is formed with a flattened portion 62. The flange 60 is attached to the shaft 10 by bolt 64.

Rotation of the cam plate 40 acts to reciprocate a catch member 66. The catch member 66 is urged by spring 68 outwardly to the position shown in FIGS. 1 and 3. The spring 68 is in a housing 70 attached on a member 72 extending from the frame 2 of the machine. The catch member 66 is provided with a primary lever 74 having a roller 76 that runs on the surface of the cam plate 40 but, upon contacting a cam 42 on the cam plate 40 the roller 76 on the end of the lever 74 is forced outwardly to pivot the lever 74 about pivot 77 thus retracting the catch member 66.

The ends of the arms 54 remote from rollers 58 are provided with rollers 75 extending downwardly into the track 48 formed in the table 46. There are channels 78 on each side of the track 48.

Figure 5:
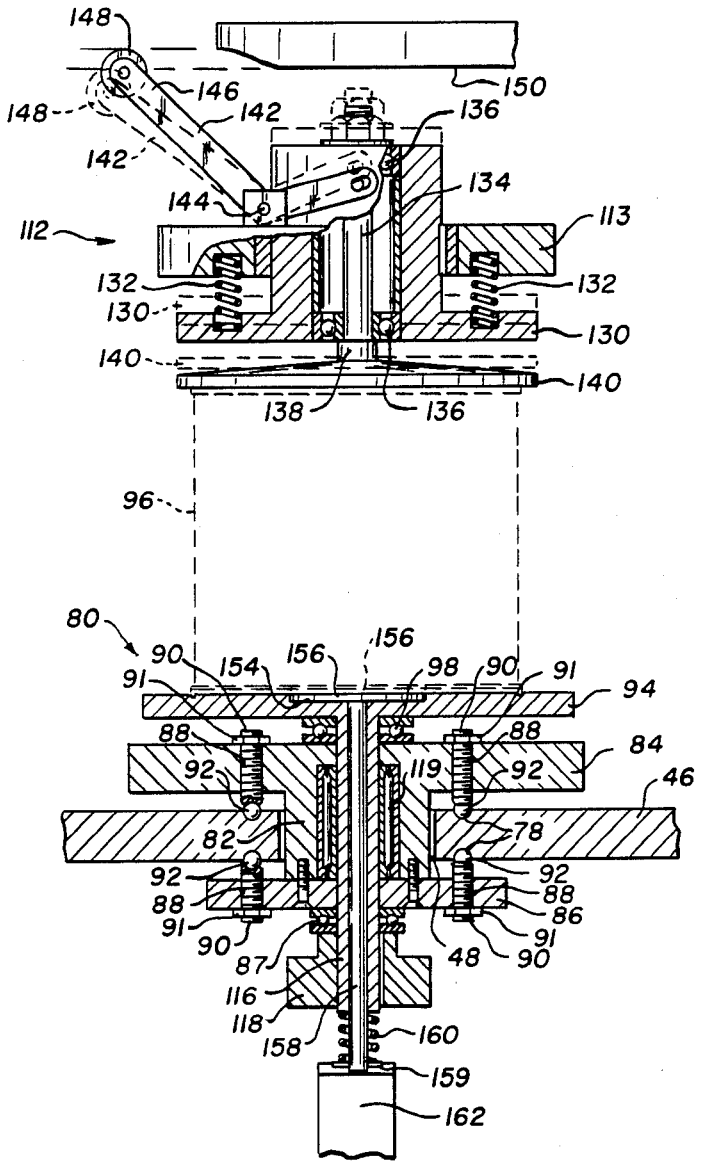
FIG. 5 is a detail of the equipment of the invention.

A plurality of carriages 80 run with the track 48—see particularly FIG. 5. The relative positioning of each carriage 80 in track 48 may be varied slightly by movable, lockable stops 49 projecting from the end of each track 48. Arms 54 act to force the carriages 80 against stops 49 and screws 55 in arms 54 are to adjust the arms 54 to ensure they are tight against carriages 80 and there is no play between carriage 80, rollers 75 and stops 49. Each carriage 80 comprises a chassis component 82 having an upper flange 84 and a lower flange 86 supported in bearing 87. The flanges 84 and 86 are provided with threaded openings 88 to receive screws 90 lockable by lock nuts 91. These screws 90 are used to level the chassis 82 relative to the table 46 by contacting ball bearings 92 rollable in the channels 78. Ball bearings 92 permit easy movement of the carriages 80 relative to the track 48 at an inspection zone. Each carriage 80 includes a base plate 94 to receive an object 96, shown in broken line in FIG. 4. Plate 94 is rotatable on bearings 98 relative to the chassis 82. An arm 100 extends from the upper flange 84 through bushing 102—see FIG. 4. A shaft 104 extends vertically from the bushing 102 and is located in the bushing 102 by screw 106. A stabilizer 108, not essential, is also attached to the rod 104 at 110 and a clamping mechanism 112 is attached to the top of the shaft 104 by use of bolt 114 attaching arm 113. Plate member 85 is attached to the flange 84 by screws 89. Member 85 bridge the space to the carriage 80 from the feed conveyor for the objects 96.

A shaft 116 is attached to the base plate 94 and extends downwardly through the chassis 82 and has attached a pulley 118, extending to contact bearing 87, at the end remote from the base plate 94. Needle roller bearing 119 facilitates rotation of shaft 116.

The apparatus is provided with an inspection zone generally defined by that area of the machine between a pulley 120 driven by electric motor 122 (see FIG. 4) mounting a belt 124 also extending around idler pulley 126 (see FIG. 3) attached at 128. The driven belt 124 contacts the pulley 118 on shaft 116 as shown in FIG. 4 to rotate the base plate 94 and thus the can 96 carried by it.

The apparatus has clamping means in the form of a top piece 130 spaced from the carriage base plate 94. The clamping means includes springs 132 urging the top piece 130 downwardly along shaft 134. The carriage and the clamping means are shown in particular detail in FIG. 5. The top piece 130 is able to move vertically relative to the arm 113. Shaft 134 is located in bearing 136 and is able to rotate relative to the top piece or arm 113. The bearing rests against flange 138. A clamping member 140 contacts the top of the can 96 and is urged downwardly as a result of its contact with the top piece 130 and the action of the springs 132.

The clamping means includes means to raise the top piece 130 against the downward force of the springs 132. That comprises a primary lever 142 with a fulcrum 144 attached to the arm 113. At one end 146, the lever 142 is provided with a roller 148 and the other end is attached to the shaft 134. As shown in FIG. 5, but as also noted in FIG. 2, the machine is provided with an abutment surface 150 extending between support members 152 shown in FIG. 1 surface 150 is aligned with the rollers 148.

In addition the base plate 94 has an indent 154 to receive raising members or lifters 156. Lifter 156 is useful in raising the can 96 to facilitate its removal from the track. A shaft 158 extends downwardly to end in a flange 159 and a spring 160 is attached between the flange 159 and the shaft 116 through which shaft 158 extends. As shown particularly in FIGS. 3 and 5 the track 78 has an abutment 162 positioned beneath it so that although the spring 160 normally urges lifter 156 downwardly contact with the abutment 162 forces the shaft 158 upwardly to raise the can 96.

Figure 1:
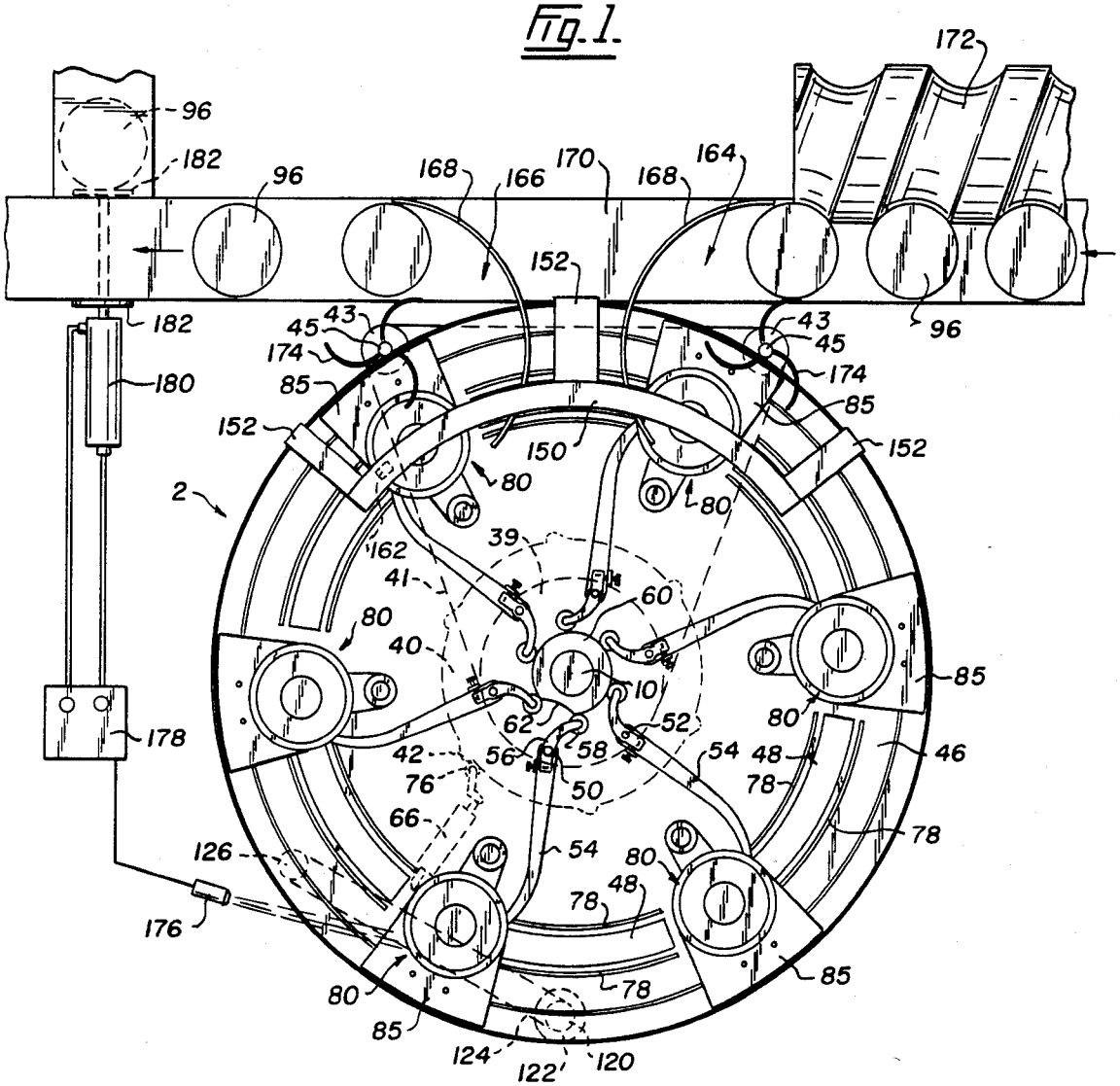
FIG. 1 is partial schematic plan view of apparatus according to the present invention.
Figure 2:
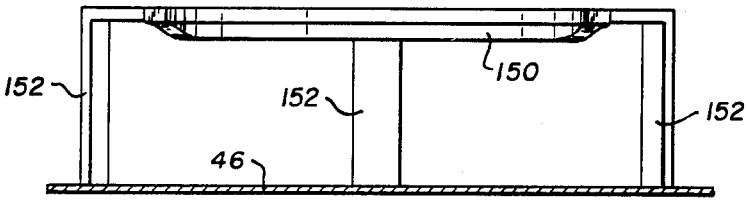
FIG. 2 is a partial detail of the equipment of FIG. 1.

As shown particularly in FIG. 1 the track has an inlet area 164 and an outlet area 166. There are guides 168 to direct the cans 96 onto and away from the carriage 80 running on the track 48. A conveyor 170 feeds cans 96 to the track and the conveyor, adjacent the inlet 164, is provided with a screw conveyor 172 which acts to separate the cans 96 as shown in FIG. 1. Rotors 174 on shafts 45 act to move the cans through the inlet 164 and outlet 166.

The inspection zone is provided with a camera 176 to scan the objects as they are rotated. The camera 176 may be attached to a computer or may simply show an image at a remote viewing station, for example by television. It is at a fixed distance from the point of the can 96 as each can is rotated and inspected.

Rejection equipment comprises a computer 178 to receive a signal from camera 176. If that signal is that a can is defective, the computer operates cylinder 180 to move pusher 182 to reject the can.

The illustrated machine functions as follows:

Cans 96 are fed along the conveyor 170 and are separated by screw 172. At the appropriate point a rotating member 174 pushing the innermost can 96 across member 85 onto carriage 80 on the track 48. The rotating member 174 is timed in such a way that when it pushes a can 96 on the track the can is automatically fed onto a carriage 80. To ensure correspondence between the incoming can 96 and carriage 80, stops 49 are first adjusted and the position of screws 55 changed as needed. As a carriage 80 moves round with the track 48, approaching the inlet 164 the lifter 156 is down in the base plate 94 but the lever 142 is activated so that the clamping member 140 is raised. Thus when a can 96 is placed on the carriage 80 the lever 142 shortly thereafter leaves surface 150 and the clamping member 140 moves downwardly under the influence of the springs 132 to locate the can 96 on the carriage 80. The carriage is moved round the track 48, carried on the ball bearings 92, and kept against stop 49 by the arms 54, that is rotating with the table 46, under, of course, the drive of the electric motor 12. Each can 96 continues with the track 48 until it approaches the stop 66. When the carriage 80 reaches the about 6 o'clock position in FIGS. 1 and 3 it will be noted that first inner roller 58 on arm 54 is aligned with the beginning of the flat portion 62 on flange 60. As the roller 58 meets the flat portion 62 the stop 66 contacts the carriage 80 and stops it moving with the track 48, the ball bearings 92 facilitating this action. The arm 54 is able to pivot about 50 or 52 and moves along the flattened portion 62 without exerting a force on the carriage 80. At the same time pulley 118 contacts the belt 124 and the carriage 80 and can 96 are rapidly rotated. As the can 96 is rotated it is scanned by camera 176.

The cam plate 40 is arranged so that as a roller 58 reaches the end of the flat portion 62 on flange 60 a cam 42 on the cam plate 40 acts to retract the stop 66 and the arm 54 moves the carriage 80 with can 96 along track 48 against stop 49 where they continue to move with the track 48 and plate 46.

The cam 42 on cam plate 40 moves past the roller 58 on the lever and the stop 66 moves outwardly immediately to be able to stop the next carriage 80. This procedure is then repeated, that is the subsequent can is inspected. The can 96 moves with the track 48 until shaft 158 contacts the abutment 162 and, more or less simultaneously, the roller 148 on lever 142 contacts surface 150. As a result the can is raised slightly above the base plate and the clamping plate 140 is moved away from the top of can 96. Rotor 174 then contacts the can, guides it against the guide 168 back onto the conveyor 170 across member 85.

If a defective can is seen by camera 176 that can is rejected as described above.

Figure 6:
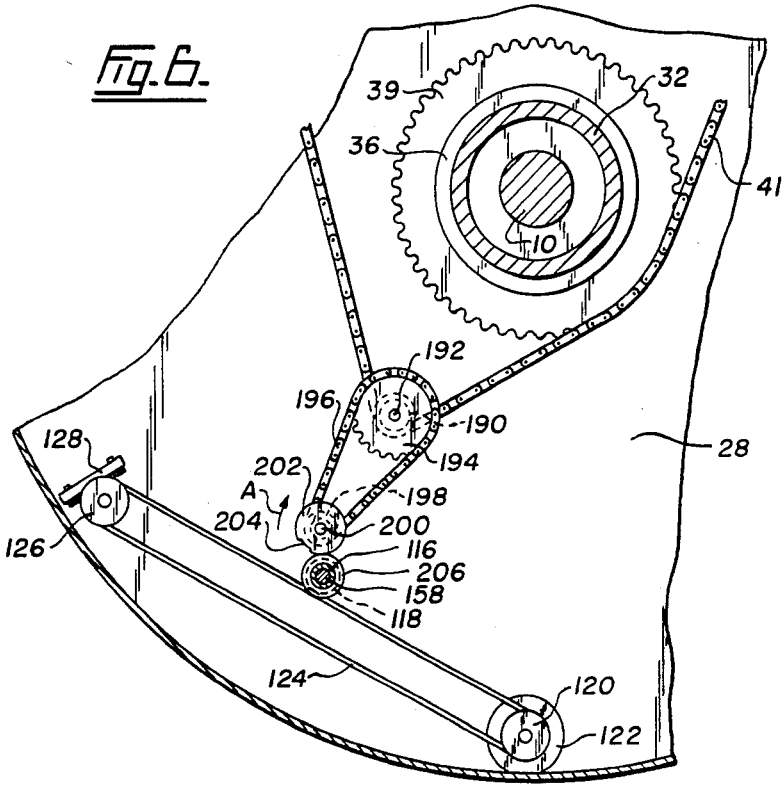
FIG. 6 is a partial plan view of a modification of the invention.
Figure 7:
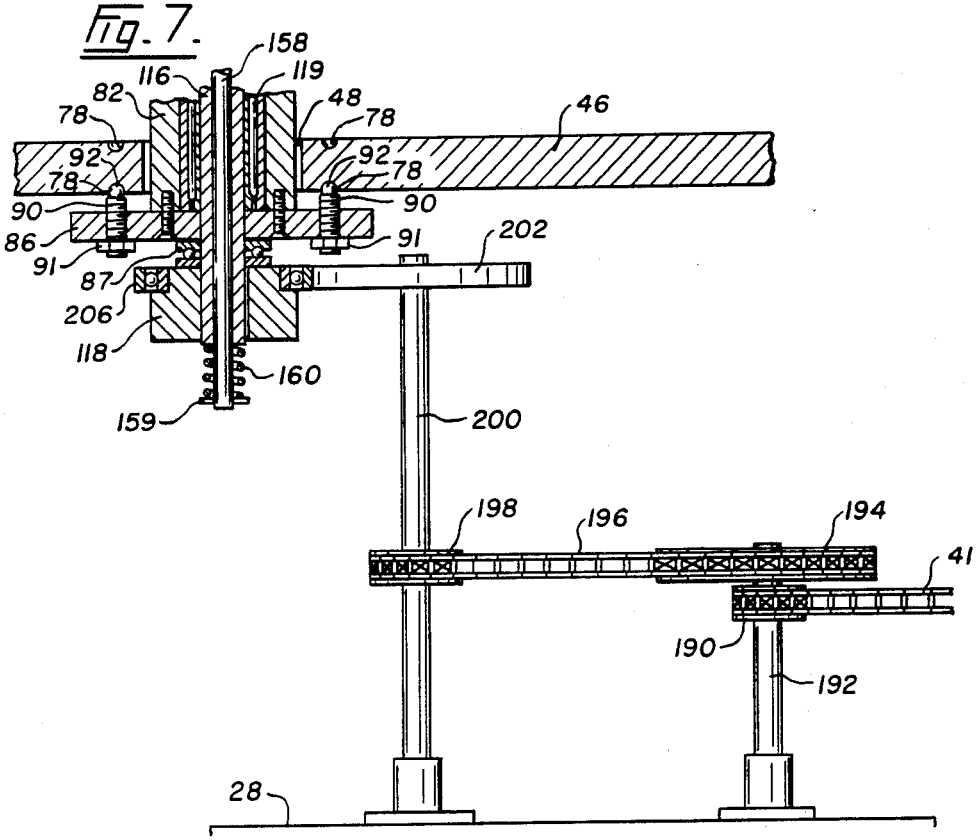
FIG. 7 is a detail of the FIG. 6 modification.

FIGS. 6 and 7 illustrate a detail of a variation of the apparatus illustrated in FIGS. 1 to 5. When the apparatus of FIGS. 1 to 5 is required to operate at extremely high speed the reciprocating action of the stop 66 can introduce noise and vibration. The embodiment of FIG. 6 and FIG. 7 is to be installed on a machine that otherwise is precisely as illustrated in FIGS. 1 to 5. In the embodiment of FIGS. 6 and 7 chain 41, driven by sprocket 39 as shown in FIG. 4, drives a sprocket 190 mounted on a jack shaft 192 on plate 28. A second sprocket 194 on jack shaft 192 drives chain 196 to rotate sprocket 198 mounted on shaft 200 also located on plate 28. At the top of shaft 200 is a brake member 202 having a recess 204 as shown in FIG. 6. As shown in FIG. 7 pulley 118 is provided with a ball bearing 206 extending outwardly from the surface of pulley 118. It should be noted that cam plate 40 of the FIGS. 1 to 5 embodiment is not present and the necessary timing is provided by the selection of sprockets 190, 194 and 198 so that sprocket 198 turns relative to sprocket 39 at a rate of 6 to 1 when 6 carriages 80 are on the machine.

The embodiment of FIGS. 6 and 7 functions as follows:

As a carriage 80 approaches the pulley 118 with ball bearing 206 the machine is timed so that ball bearing 206 abuts member 202 at the position shown in FIG. 6 where member 202 is rotating in the direction of arrow A. The machine is timed so that in the FIG. 6 position the arm 54 in contact with the partially illustrated carriage 80 is just at the start of flat 62 on flange 60 on shaft 10. As shown in FIG. 6 at this point belt 124 rotates the can by rotating pulley 118 precisely as described above for the embodiment of FIGS. 1 to 5. That action is completed and recess 204 in member 202 aligns with the bearing 206 so that the braking effect is stopped, that is there is no obstruction in front of the bearing 206, and thus attached carriage 80, and at that stage arm 54 is timed so that it has reached the end of flat 62 on flange 60 on shaft 10.

Once released carriage 80 is moved by arm 54 against stop 49 at the end of its track 48 precisely as described for the previous embodiment. The procedure is then the same.

The advantage of the FIGS. 6 and 7 embodiment is quietness and smoothness of operation. There is no reciprocation and the rotation of the member 202 is absorbed by ball bearing 206.

The apparatus of the present invention thus provides a continuous inspection device in which extremely rapid rates of inspection can be achieved, rates so rapid that the normal production line is not in any way slowed.

I claim:

1. An apparatus to permit inspection of an object, the apparatus comprising:

a central fixed shaft;

a table rotatably attached to the shaft;

a circumferential opening in the table to define a track with which the object can move;

means to rotate the table;

means to carry the object along with the track comprising a carriage movable in the track, the carriage comprising a chassis adapted to move along the track and a base plate to receive the object, the base plate being rotatable relative to the chassis;

clamping means to hold the object as it moves;

channels in the table on each side of the track, on the top and bottom of the table, an upper flange and a lower flange on the chassis, extending over the channel, rolling means associated with each flange to engage in a channel;

means defining an inspection zone on the track;

means to stop the object moving along with the track at the inspection zone; and means to rotate the object in the inspection zone so it may be inspected.

2. Apparatus as claimed in claim 1 in which the rolling means are ball bearings.

3. Apparatus as claimed in claim 1 including a rotatable shaft extending from the base plate of the carriage through the chassis and rotatable in the chassis;

drive means in the inspection zone to rotate the chassis, and thus the base plate, to enable the inspection of the object in the inspection zone.

4. Apparatus as claimed in claim 3 in which the drive means comprises a driven pulley;

an idler pulley spaced from the driven pulley;

a belt extending round the driven pulley and the idler pulley positioned to drive the shaft.

5. Apparatus as claimed in claim 4 including a pulley on the rotatable shaft to contact the belt.

6. Apparatus to permit inspection of an object, the apparatus comprising:

a central fixed shaft;

a table rotatably attached to the shaft;

a circumferential opening in the table to define a track with which the object can move;

means to rotate the table;

means to carry the object along with the track comprising a carriage movable in the track, the carriage comprising a chassis adapted to move along the track and a base plate to receive the object, the base plate being rotatable relative to the shaft;

clamping means to hold the object as it moves, comprising a top piece spaced from the carriage base plate;

first resilient means urging the top piece downwardly, to clamp the object;

means to apply a force to the top piece to raise it against the resilient means to release the object;

the base plate including a raisable part to facilitate the moving of the object from between the top piece and the base plate;

second resilient means to keep the raisable part within the base plate; and means to lift the raisable part adjacent an outlet of the track against the action of the second resilient means;

means defining an inspection zone on the track;

means to stop the object moving along with the track at the inspection zone; and means to rotate the object in the inspection zone so it may be inspected.

7. Apparatus as claimed in claim 6 in which the means to lift the arm comprises a shaft projecting below the base plate;

an abutment beneath the track to contact the shaft and thus raise the base.

8. Apparatus as claimed in claim 6 in which the top piece comprises a fixed piece and a vertically movable piece with resilient means extending between the fixed and the movable pieces to urge the movable piece downwardly.

9. Apparatus as claimed in claim 8 in which the means to raise the top piece comprises a primary lever with the first end extending upwardly from the top piece and pivotally attached to the fixed piece at a fulcrum;

a second end of the lever attached to the movable piece whereby depression of the first end raises the movable piece.

10. Apparatus as claimed in claim 9 in which the track has an inlet and an outlet and in which the apparatus includes means to operate the clamping means to clamp the object adjacent the inlet and means to release the clamping means adjacent the outlet.

11. Apparatus as claimed in claim 10 including an abutment surface extending radially from before the outlet to after the inlet whereby the primary lever is kept down and the movable piece raised as the top piece passes by the abutment surface.

12. Apparatus to permit inspection of an object, the apparatus comprising a central fixed shaft;

table rotatably attached to the shaft;

a circumferential opening in the table to define a track with which the object can move;

means to rotate the table;

means to carry the object along with the track comprising a carriage movable in the track, the carriage comprising a chassis adapted to move along the track by an arm abutting the carriage and pivotally attached to the table;

clamping means to hold the object as it moves;

means defining an inspection zone on the track;

means to stop the object moving along with the track at the inspection zone;

means to rotate the object in the inspection zone so it may be inspected;

a flange attached to the central shaft;

a flattened portion in the flange radially aligned with the inspection zone;

the arm including a dog-leg extending to contact the flange whereby the arm cannot rotate out of contact with the carriage under the influence of the weight of the object but the flat portion allows the arm to pivot to cease moving the carriage along the track in the inspection zone.

13. Apparatus to permit inspection of an object, the apparatus comprising:

a central fixed shaft;

a table rotatably attached to the shaft;

a circumferential opening in the table to define a track with which the object can move;

means to rotate the table;

means to carry the object along with the track comprising a carriage movable in the track, the carriage comprising a chassis adapted to move along the track and the base plates to receive the object, the base plate being rotatable relative to the shaft; a cam plate to rotate with the table;

a reciprocable stop member in the inspection zone;

means urging the stop member outwardly to abut a carriage to stop the carriage in the inspection zone;

a lever attached to the stop member;

contact of a cam on the cam plate acting through the lever to retract the stop member to allow the carriage to proceed with the track.

14. Apparatus as claimed in claim 13 to handle a plurality of objects and including a plurality of carriages and an equal number of arms and of clamping top pieces.

15. Apparatus as claimed in claim 1 including a supply conveyor to feed the objects to and from the apparatus;

means associated with the supply conveyor to separate the objects prior to feeding to the track.

16. Apparatus as claimed in claim 15 including means to transfer the objects to the track from the supply conveyor and from the track to the conveyor after the objects have moved around the track.

17. Apparatus as claimed in claim 1 in which the inspection zone has associated with it a camera to inspect the objects.

18. Apparatus as claimed in claim 1 including a reject mechanism to remove defective objects.

19. Apparatus as claimed in claim 1 in which the means to stop the object moving along with the track at the inspection zone comprises a circular stop member adapted to contact a projection on the means to carry the object along with the track;

a recess in the stop member whereby alignment of the recess with the projection releases the means to carry the object so that it continues along with the track.

20. A machine as claimed in claim 19 in which the projection comprises a ball bearing able to rotate during contact with the stop member.

* * * * *